United States Patent [19]

Freistadt

[11] 4,273,274

[45] Jun. 16, 1981

[54] CONVERTIBLE HANDBAG AND BACKPACK

[76] Inventor: Margo S. Freistadt, 670 Greenwich St., San Francisco, Calif. 94133

[21] Appl. No.: 46,358

[22] Filed: Jun. 7, 1979

[51] Int. Cl.[3] ..... A45C 13/26

[52] U.S. Cl. ..... 294/141; 150/1; 150/12; 150/33; 224/151; 224/209

[58] Field of Search ..... 224/46 R, 151, 154, 224/209, 31, 45 P, 45 R; 150/1, 33, 1.6, 1.7, 3, 12

[56] References Cited

U.S. PATENT DOCUMENTS

| | | | |
|---|---|---|---|
| 2,464,069 | 3/1949 | Benson | 224/45 R |
| 3,019,952 | 2/1962 | Brewster | 224/209 |
| 3,802,613 | 4/1974 | Droeger | 224/46 R X |

FOREIGN PATENT DOCUMENTS

| | | | |
|---|---|---|---|
| 494731 | 6/1950 | Belgium | 150/33 |
| 62105 | 2/1890 | Fed. Rep. of Germany | 224/209 |

*Primary Examiner*—Robert J. Spar
*Assistant Examiner*—Jerold M. Forsberg
*Attorney, Agent, or Firm*—Manfred M. Warren; Robert B. Chickering; Glen R. Grunewald

[57] ABSTRACT

A convertible handbag and backpack is disclosed which includes a bag body to which a pair of carrying straps are secured. The straps are secured to the bag near the bottom of the bag body and are slidably mounted to a side of the bag body proximate the top of the bag. Intermediate the bottom securement and slidable mount at the top, the straps are unattached to the bag body. The carrying straps further extend above the bag, cross each other over the top of the bag, and are secured to diametrically opposed positions on the opposite side of the bag body. When the convertible handbag and backpack is carried as a handbag, the crossed straps are simply gripped over the bag top. When the bag is carried as a backpack, the straps are slipped down through the mounting structure to permit insertion of the arms of the user between the straps and the bag body. In the backpack carrying mode the crossed straps are automatically pulled down over the top of the bag body to insure that the bag top does not fall open.

2 Claims, 6 Drawing Figures

CONVERTIBLE HANDBAG AND BACKPACK

BACKGROUND OF THE INVENTION

The desirability of providing a handbag that can also be carried as a backpack has long been recognized. The size of handbags has steadily increased over the years as both men and women have found it highly desirable to carry bulky and sometimes heavy objects with them in connection with a variety of undertakings. Such large bags are particularly popular with students, since they permit the carrying of books, binders, calculators, etc.

While such large handbags can be carried by handles of the type which are found on a conventional satchel bag, or optionally can be carried by a shoulder strap, it has also been found to be very convenient to be able to convert such bags for carrying as a backpack.

Accordingly, various handbag strap assemblies have been provided which enable selective carrying of a bag as a handbag or as a backpack. Typical of such structures are the convertible handbags disclosed in the following U.S. Pat. Nos.: 3,938,716, 3,802,613, 3,622,056, 3,346,155, 3,019,952 and 2,515,316. These patents include carrying strap assemblies having auxiliary straps, straps that are provided with snaps that can be releasably secured at various positions on the bag, and straps that are slidably mounted to the bag.

While there is little problem in keeping an open topped bag from spilling its contents when it is carried as a satchel or handbag, once an open topped bag is converted for carrying as a backpack, the possibility of accidental discharge of its contents is great. The convertible strap structures heretofore employed in the above patents have not been suitable for maintaining the open top of the bag in a relatively secure and closed condition. Instead it has been necessary to provide auxiliary structures, such as zippers, flaps and the like, to keep the bag top from falling open when the bag is being carried in the backpack mode.

The problem of keeping the bag closed when used as a backpack can be most easily illustrated by reference to U.S. Pat. No. 3,802,613. This patent discloses a slidable strap structure in which one strap can be selectively moved to and from a position enabling the bag to be carried as a handbag and a position in which the arms of the user can be inserted between the strap and the bag to carry the same as a backpack. As will be apparent, however, since only one strap on one side of the bag is pulled to a position enabling carrying of the bag as a backpack, the top of the bag is not secure unless it is fastened, e.g., by a zipper, to the opposite side of the bag. Moreover, and equally importantly, since only one strap is slidably mounted to the bag of U.S. Pat. No. 3,802,613, the length of the strap inherently must be relatively long in order to provide sufficient slack for both of the user's shoulders when the bag is carried as a backpack. Such strap length either requires constant adjustment of the strap length or results in a strap which is undesirably long when the bag is carried as a handbag.

OBJECTS AND SUMMARY OF THE INVENTION

A. Objects of the Invention

It is an object of the present invention to provide a convertible handbag and backpack having a carrying strap structure which enables carrying of the bag in a backpack mode with the contents of the bag secure against accidental spilling from the bag.

Another object of the present invention is to provide a convertible handbag and backpack having a carrying strap structure which enables the bag to be constructed with an open top enabling easy and rapid access to and from the bag for loading and unloading.

Another object of the present invention is to provide a convertible handbag and backpack having a carrying strap structure that accommodates carrying as both a backpack and a handbag without the need for adjustment of the strap length and without undesirably long straps.

Still a further object of the present invention is to provide a convertible handbag and backpack having a strap structure which can be readily adjusted between handbag and backpack modes, has a simple uncluttered design which is inexpensive to construct and suitable for relatively low cost bags, and yet is rugged, durable and amenable to repeated and prolonged use.

The convertible handbag and backpack of the present invention has other objects and features of advantage which will be apparent from the accompanying drawing or are set out in detail in the description of the preferred embodiment.

B. Summary of the Invention

The convertible handbag and backpack of the present invention includes a bag body having a bottom and upwardly extending opposite side and end panels, a pair of carrying straps secured to the bag body proximate the bottom and extending in an unattached condition upwardly along the sides of the bag to a position above the top of the body, and mounting means slidably mounting an intermediate portion of the straps to at least one of the opposite sides of the bag proximate the bag top in a manner enabling insertion of the arms of the user between the side of the bag and the straps for carrying of the bag as a backpack. The improvement in the convertible handbag and backpack of the present invention is comprised, briefly, of each of the carrying straps being secured proximate opposite ends thereof to opposite sides of the bag body, with each of the straps extending from the mounting means over the top of the bag body to a diametrically opposed position on an opposite side of the bag body, and the straps crossing each other along substantially diagonally extending lines over the top of the bag body. As thus constructed, the bag can be carried by the crossed straps as a handbag. Moreover, sliding of the straps in the mounting means produces sufficient slack between the straps and the side of the bag to enable the bag to be carried as a backpack, with the straps automatically pulled down over and across the open top of the bag.

DESCRIPTION OF THE PREFERRED EMBODIMENTS

Figure 1:
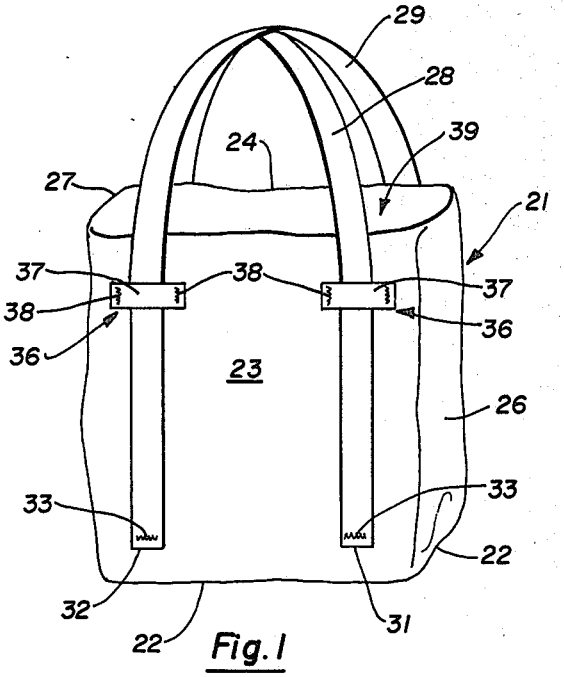
FIG. 1 is a top perspective view of a convertible handbag and backpack constructed in accordance with the present invention with the carrying straps shown for carrying as a handbag.

The convertible handbag and backpack of the present invention includes a bag body, generally designated 21, having a bottom panel 22 and upwardly extending opposite side panels 23 and 24, as well as upwardly extending opposite end panels 26 and 27. Mounted to bag body 21 are a pair of carrying straps 28 and 29, which are secured to the bag proximate the bottom panel 22 of the bag. As shown in the preferred form, the ends 31 and 32 of the straps are secured by stitching or the like 33 to side panel 23 adjacent the lower edge of the side of the bag body. Thus, carrying straps 28 and 29 extend upwardly along side panel 23 of the bag to a position above the top of the bag body to enable carrying of the bag by straps as a handbag.

In order to facilitate conversion of the handbag for carrying as a backpack, the convertible handbag and backpack of the present invention further includes mounting means, generally designated 36, formed for slidable mounting of intermediate portions of straps 28 and 29 to at least one of the opposite side panels 23 and 24 of the bag body. In the preferred form, mounting means 36 is comprised of a pair of transversely extending strips of material 37 which are secured across straps 28 and 29, for example by stitching 38, so as to slidably mount the straps to the bag side at a position proximate the top and end panels of the bag body. Carrying straps 28 and 29 are not attached to side panel 23 intermediate mounting means 36 and the points of securement to the bag body, namely, ends 31 and 32 of the straps.

Figure 2:
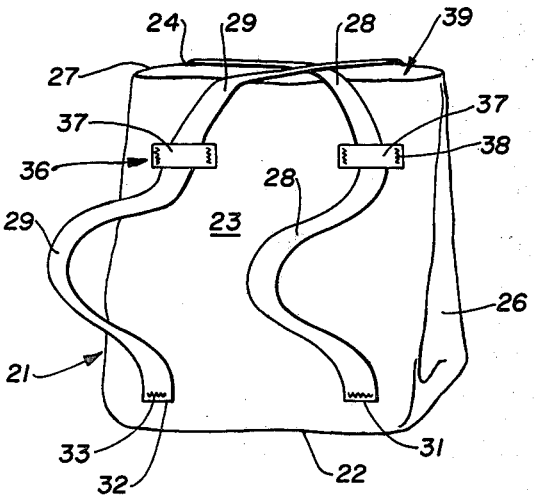
FIG. 2 is a top perspective view of the handbag in FIG. 1 with the straps in position for carrying of the bag as a backpack.
Figure 3:
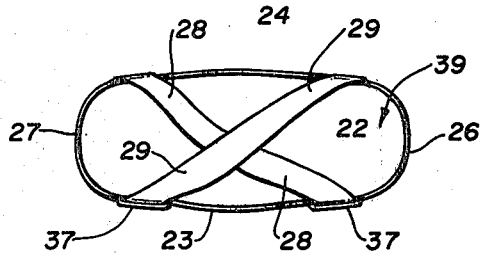
FIG. 3 is a top view of the backpack of FIG. 1.

When the bag is to be carried as a backpack, straps 28 and 29 may be slipped down underneath the transverse strips 37 to the position shown in FIG. 2, which enables insertion of the arms of the user between side 23 of the bag and straps 28 and 29. The straps can, therefore, be used to mount the bag over the shoulders of the user for carrying the bag as a backpack. The transverse strips and slidable mounting of the carrying straps to a side wall of the bag is known in the prior art (for example, U.S. Pat. No. 3,802,613), and such a construction, per se, is not regarded as being novel.

One of the problems in connection with prior convertible handbags and backpacks, including the bag of U.S. Pat. No. 3,802,613, has been that when the bag is carried in the backpack mode by slipping the straps to the position of FIG. 2, the bag will flop open, thus requiring a separate closure structure for the top of the bag. The improved convertible handbag and backpack of the present invention is suitable for use with bags having open tops, such as open top 39. This is accomplished by an improved carrying strap structure. In U.S. Pat. No. 3,802,613 the opposite ends of the carrying straps are mounted to the same side of the bag. Thus, when a carrying strap is slipped to the backpack carrying position, the opposite strap remains unused, and the far side of the bag remains free and uncontrolled by the carrying straps.

In the improved handbag of the present invention each of straps 28 and 29 is secured proximate opposite ends thereof to opposite sides of the bag body. Thus, by comparing FIGS. 1 and 4, first end 31 of strap 28 can be seen to be secured to side 23 proximate bottom 22 and end panel 26. The opposite or second end 41 of strap 28 is secured, not to side 23, but instead to side 24 proximate end panel 27. Similarly, the first end 32 of strap 29 is secured to side 23 proximate bottom 22 and end panel 27. The second or opposite end 42 of strap 29 is secured to the second or opposite side 24 of the bag body proximate end panel 26. The straps, therefore, extend from mounting means 36 over open top 39 of the bag body to a diametrically opposed position on an opposite side of the bag body, with the straps crossing each other along substantially diagonally extending lines over the open top of the bag body.

The crossed straps can be readily grasped or clutched for carrying of the bag as a handbag. Moreover and more importantly, when the straps are slipped to the backpack carrying position of FIG. 2, the crossed straps which extend over the open top of the bag are automatically pulled down to thereby pull sides 23 and 24 relatively close together and position the straps in close proximity over the open top. In the present invention, therefore, the carrying straps not only function to enable conversion of the bag to and from handbag and backpack carrying modes, but they also function to provide an automatically operating structure for making the open top of the bag relatively secure against the accidental spilling of contents from the bag when it is carried as a backpack.

Additionally, it should be noted that the crossed straps enable conversion to the backpack mode without any necessity of shifting or repositioning the contents of the bag. Still further, the crossing of the straps does not pull end panels 26 and 27 toward each other to a significant degree. Even fabric bags that are rectangular in form, as shown in the drawing, tend to keep their rectangular shape when the bag is carried as a backpack or handbag. The crossing has more effect in pulling sides 23 and 24 toward each other, than pulling the ends toward each other. Undoubtedly, as the sides are pulled together the rigidity of the bag against having the ends pulled together increases.

The crossed carrying strap structure of the present invention has an additional important advantage over prior sliding strap structures, such as the bag of U.S. Pat. No. 3,802,613. Since both straps 28 and 29 are slidably mounted to the bag, the slack in the straps produced by sliding the straps to the position of FIG. 2 is twice that which would be produced for the same length of strap in U.S. Pat. No. 3,802,613. Thus, in the device of the prior patent a single strap is slidably mounted to one side of the bag. When the strap is slipped to the backpack position, the length of the single strap must provide the slack necessary for both shoulders of the user. This requires very long straps or strap adjustment means.

In the strap structure of the present invention both straps slide so that each contributes to the slack necessary for carrying of the bag as a backpack. The straps, therefore, can be shorter and carrying of the bag as a handbag is made more convenient. Additionally, the crossed strap construction in which both straps contribute to the slack for carrying as a backpack makes the bag more universal or capable of accommodating users of various sizes.

Figure 4:
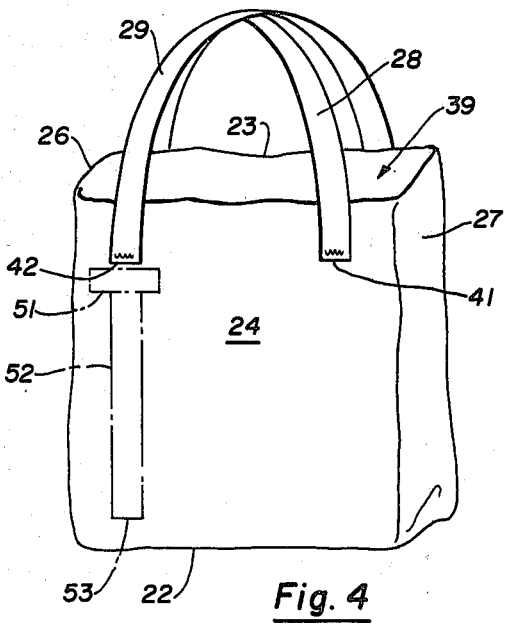
FIG. 4 is a top perspective view of the opposite side of the convertible handbag and backpack of FIG. 1, showing a modified form in phantom lines.

An alternate embodiment of the backpack of the present invention is shown in phantom in FIG. 4. Instead of securing the ends 41 and 42 of straps 28 and 29 proximate upwardly facing open top 39 on second side 24 of the bag, it is possible to provide a mounting means 51 proximate top 39 and a strap extension 52, with the strap extension end 53 being secured proximate bottom 22 of the bag body. This structure is shown for only one of the straps, but it will be appreciated that both straps would be similarly secured to side 24 of the bag. Such a configuration would enable carrying of the bag in the backpack mode from either of sides 23 or 24, and in each instance, the straps would automatically be pulled down over the open top 39 of the bag.

Figure 5:
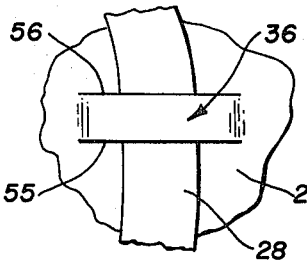
FIG. 5 is an enlarged, fragmentary view of an alternative embodiment of the straps mounting structure shown in FIG. 1.

It is possible to form mounting means 36 as a pair of transversely extending vertically spaced apart slits 55 and 56, as best seen in FIG. 5, dimensioned for receipt of a carrying strap, for example, carrying strap 28. Similarly, strap rings of the type often employed in backpacks could be used to slidably secure the straps to the bag side panels.

Figure 6:
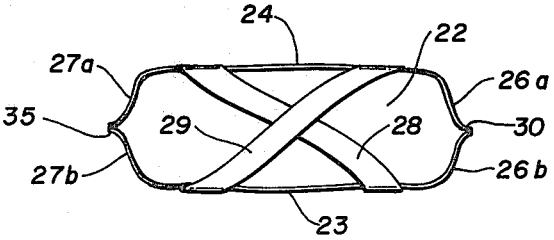
FIG. 6 is a top view of an alternative embodiment of the bag body suitable for use in the present invention.

In FIG. 6 a further alternative embodiment of the convertible handbag and backpack of the present invention is shown. In this embodiment, the end panels are formed by extensions of the side panels. The first end panel is comprised of panel portions 26*a* and 26*b*, which are secured or fastened together, for example, by stitching along a seam 30. Similarly, the opposite end panel is comprised of portions 27*a* and 27*b*, which are secured or stitched together along seam 35. The remainder of the convertible handbag and backpack is the same previously described, except that carrying strap 28 is shown crossing over the top of carrying strap 29.

As will be appreciated, there are undoubtedly other constructions of the bag body which are suitable for use with the improved strap structure of the present invention. A circular bag body having spaced apart straps that crossed each other over the top of the bag and were secured to opposite sides of the bag could also be employed. The preferred form, which is particularly well suited for carrying bulky items such as books, binders and the like, includes side panels which have a greater transverse dimension than the transverse dimension of the end panels, but other configurations are suitable for use with the strap structure of the present invention.

The improved convertible handbag and backpack of the present invention can be formed of many different kinds of materials. The automatic securement of the open top of the bag by the carrying straps makes formation of the bag from simple canvas material quite practical. Thus, a very low cost bag can be constructed which is suitable for carrying as a backpack. As will be appreciated, it is possible if desired to provide the bag with means for adjustment of the length of the carrying straps or a zipper or snaps to secure small items in the bag, but such features are optional and not necessary to proper function of the convertible handbag and backpack.

What is claimed is:

1. A bag having a pair of carrying straps mounted thereto for movement between two positions for carrying of said bag as a handbag, a shoulder bag and a backpack; said bag including a bag body having a bottom panel, opposite side panels and opposite end panels, said bottom panel being elongated and said side panels each having a greater transverse dimension than the transverse dimension of said end panels; a first carrying strap having a first end secured to a first side panel proximate said bottom panel and proximate a first end panel; a second carrying strap having a first end secured to said first side panel proximate said bottom panel and proximate a second end panel, said straps each extending upwardly along said first side panel over the top of said bag and terminating in a second end secured to a second side panel; and mounting means slidably mounting each of said straps to said first side panel proximate the top of said bag, said straps each being unattached to said first side panel intermediate said mounting means and said first ends; wherein the improvement in said bag comprises:

said side panels and said end panels terminating in and defining an open bag top;

said bag body being formed of a flexible material proximate said open bag top;

said mounting means being further secured to said first side panel to position an intermediate portion of said first strap proximate said first end panel and an intermediate portion of said second strap proximate said second end panel;

said straps extending from said mounting means and crossing over said open bag top along substantially diagonally extending lines with said second end of said first strap being secured to said second side panel proximate said second end panel and said second end of said second strap being secured to said second side panel proximate said first end panel; and said straps being secured to said bag body and slidably mounted by said mounting means for movement between a first position at which the crossed straps:

(i) may be gripped by the hand of the user for carrying as a handbag, and (ii) define an opening over said open bag top lying in a plane parallel to said side panels through which the arm and shoulder of the user may be inserted for carrying of the bag as a shoulder bag, and a second position at which the crossed straps are pulled down over and hold closed said open bag top by pulling said flexible material proximate said bag top together, said straps in said second position being slid down through said mounting means to enable insertion of the arms of the user between said straps and said first side panel for carrying of said bag as a backpack.

2. The bag as defined in claim 1 wherein, said second end of said first strap is secured to said second side panel proximate said bottom and proximate said second end panel, and mounting means slidably mounting said first strap to said second side panel proximate said open bag top and proximate said second panel; and said second end of said second strap is secured to said second side panel proximate said bottom and proximate said first end panel, and mounting means slidably mounting said second strap to said second side panel panel proximate said open bag top and proximate said second end panel.

* * * * *